US005362152A

United States Patent [19]

Fletcher et al.

[11] Patent Number: 5,362,152

[45] Date of Patent: Nov. 8, 1994

[54] T-SHIRT TYPE PLASTIC BAG FOR CARRYING HOT FOOD

[75] Inventors: Wade D. Fletcher; Harry B. Wilfong, Jr., both of Hartsville, S.C.

[73] Assignee: Sonoco Products Company, Hartsville, S.C.

[21] Appl. No.: 126,274

[22] Filed: Sep. 24, 1993

[51] Int. Cl.[5] ..... B65D 33/01

[52] U.S. Cl. ..... 383/8; 383/103; 383/120

[58] Field of Search ..... 383/8, 100, 102, 103, 383/120

[56] References Cited

U.S. PATENT DOCUMENTS

| | | |
|---|---|---|
| 2,697,832 | 12/1954 | Stich . |
| 3,097,787 | 7/1963 | Schur . |
| 3,399,822 | 9/1968 | Kugler . |
| 3,432,087 | 3/1969 | Costello . |
| 4,141,487 | 2/1979 | Faust et al. . |
| 4,491,959 | 1/1985 | Loefberg . |
| 4,497,431 | 2/1985 | Fay . |
| 4,503,561 | 3/1985 | Bruno . |
| 4,576,316 | 3/1986 | Foster . |
| 4,698,226 | 10/1987 | Guthrie . |
| 4,741,909 | 5/1988 | Guthrie . |
| 5,114,766 | 5/1992 | Jacques . |

FOREIGN PATENT DOCUMENTS

| | | | |
|---|---|---|---|
| 0639709 | 4/1962 | Canada | 383/103 |
| 1201537 | 9/1965 | Germany | 383/103 |
| 2802849 | 7/1978 | Germany | 383/103 |
| 2807162 | 8/1978 | Germany | 383/103 |
| 0886612 | 1/1962 | United Kingdom | 383/103 |
| 2141688 | 1/1985 | United Kingdom | 383/100 |

*Primary Examiner*—Allan N. Shoap
*Assistant Examiner*—Jes F. Pascua
*Attorney, Agent, or Firm*—Bell Seltzer Park

[57] ABSTRACT

A T-shirt type plastic bag is adapted for carrying hot foods from fast food restaurants. The bag includes front and rear wall sections, gussetted side wall sections integrally connecting the front and rear wall sections together and means connecting the bottoms of the front, rear and gussetted side wall sections together to define a closed bottom. At least a part of the front and rear wall sections are open at the tops to define a mouth portion. Laterally spaced handles are integral with the front, rear and gussetted side wall sections and extend upwardly from opposed sides of the mouth portion. Apertures extend through at least one of the wall sections for providing a path for a venting air flow from the outside of the bag and through the inside of the bag when the bag is carrying hot food.

10 Claims, 2 Drawing Sheets

T-SHIRT TYPE PLASTIC BAG FOR CARRYING HOT FOOD

FIELD OF THE INVENTION

This invention relates to a T-shirt type plastic bag particularly adapted for carrying hot food from fast food restaurants.

BACKGROUND OF THE INVENTION

Plastic bags have been replacing paper bags in the United States since the 1970s for the grocery and retail products industries due to the superior and inherent moisture resistant properties and strength of plastic among other things. For these industries, these plastic bags usually are of the T-shirt type which include front and rear wall sections integrally connected together by gussetted side walls and connected at the bottoms to define a closed bottom on the bag. At least a part of the front and rear wall sections are open at the tops to define a mouth portion. Laterally spaced handles integral with the front, rear and gussetted side wall sections extend upwardly from opposed sides of the mouth portion.

These types of bags for the grocery and retail products industries have been marketed by the assignee of the present invention as the highly commercially successful QUIKMATE® bagging system, set forth in United States Reissue Patent Re. 33,264, reissued Jul. 17, 1990, and which includes a plurality of such T-shirt bags formed into a bag pack and mounted on a rack for being opened and loaded one at a time and removed from the rack after being loaded.

Notwithstanding the success of plastic bags and replacement of paper bags in the above discussed grocery and retail products industries, paper bags have continued to be used in the fast food restaurant industry for packaging and carrying hot foods. However, there are several problems associated with the use of paper bags in the fast food restaurant industry, such as the difficulty in handling of such paper bags, the inherent opaque nature of such paper bags resulting in the inability to see the hot food items packed in the bag and resulting mistakes in filling customers' orders, productivity costs, inherent weakness in such bags when they become moist or the like, etc. On the other hand, plastic bags have not been used for packaging and transporting hot foods in the fast food restaurant industry primarily because of the problem which occurs with moisture collecting on the insides of the plastic bag when filled with hot foods. This moisture will condensate and cause the food to get soggy and will wet the hand of the user when reaching into the bag.

OBJECT AND SUMMARY OF THE INVENTION

Accordingly, it is the object of this invention to provide a plastic bag of the T-shirt type which will overcome the problems heretofore considered prevalent with the use of .plastic bags in packaging hot foods in the fast food restaurant industry.

By this invention, it has been found that the above object may be accomplished by providing a T-shirt plastic bag which has been particularly adapted for carrying hot food from fast food restaurants and being constructed generally as follows.

The T-shirt type plastic bag of this invention comprises front and rear wall sections and gussetted side wall sections integrally connecting the front and rear wall sections together. Means are provided for sealing or connecting the bottoms of the front, rear and gussetted side wall sections together to define a closed bottom. At least a part of the front and rear wall sections are open at the tops to define a mouth portion. Laterally spaced handles integral with the front, rear and gussetted side wall sections extend upwardly from opposed sides of the mouth portion. Aperture means extend through at least one of the above defined wall sections for providing a path for a venting air flow from the outside of the bag and through the inside of the bag when the bag is carrying hot food to prevent undesirable moisture from collecting on the sides of the bag and from condensing in the bag.

BRIEF DESCRIPTION OF THE DRAWINGS

Some of the objects and advantages of the invention having been set forth, other objects and advantages will appear from the following detailed description of a preferred embodiment of the invention, when taken in conjunction with the accompanying drawings, in which.

DETAILED DESCRIPTION OF PREFERRED EMBODIMENT OF THE INVENTION

Figure 1:
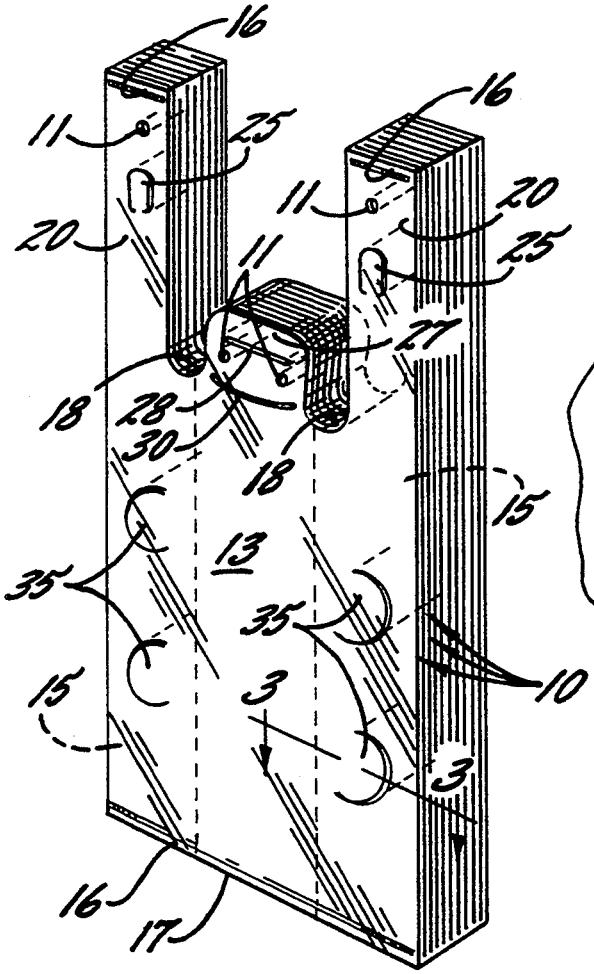
FIG. 1 is a perspective view of a pack of T-shirt plastic bags constructed in accordance with this invention.

Referring now to the drawings, there is shown in FIG. 1 a plurality of T-shirt type plastic bags formed into and held in a pack of such bags 10 in a well known manner including hot or cold staking at areas 11. The bags 10 may be formed of any suitable material including preferably a high density polyethylene film material well known in this industry.

Each of these T-shirt type plastic bags comprise front and rear wall section 13, 14 and gussetted side wall section 15 integrally connecting each side of said front and rear wall sections together. Means, preferably in the form of heat sealing 16, connects the bottoms of the front, rear and gussetted side wall sections 13, 14 and 15 together to define a closed bottom 17. At least a part of the front and rear wall sections are open at the tops to define a mouth portion 18. Laterally spaced handles are integral with the front, rear and gussetted side wall sections 13, 14 and 15 and extend upwardly from opposed sides of the mouth portion 18 and are closed at their tops by heat sealing 16.

For mounting the pack of bags 10 onto a conventional rack 23, apertures 25 are formed in the handles 20 so that the bags 10 may be positioned on arms 26 of the rack 23. There is also provided a central mounting tab 27 on each of the bags which forms an extension of the front and wall sections 13, 14 and which includes a slot 28 therethrough for mounting the tab 27 on a hook portion 29 of the rack 23. These central mounting tabs 27 are detachable by tearing the bag on each side of a cut 30 in the front and rear wall sections 13, 14 as the bag 10 is removed from the pack of bags and slid to its open position on the arms 26 of the rack 23, as shown in FIG. 5.

Figure 5:
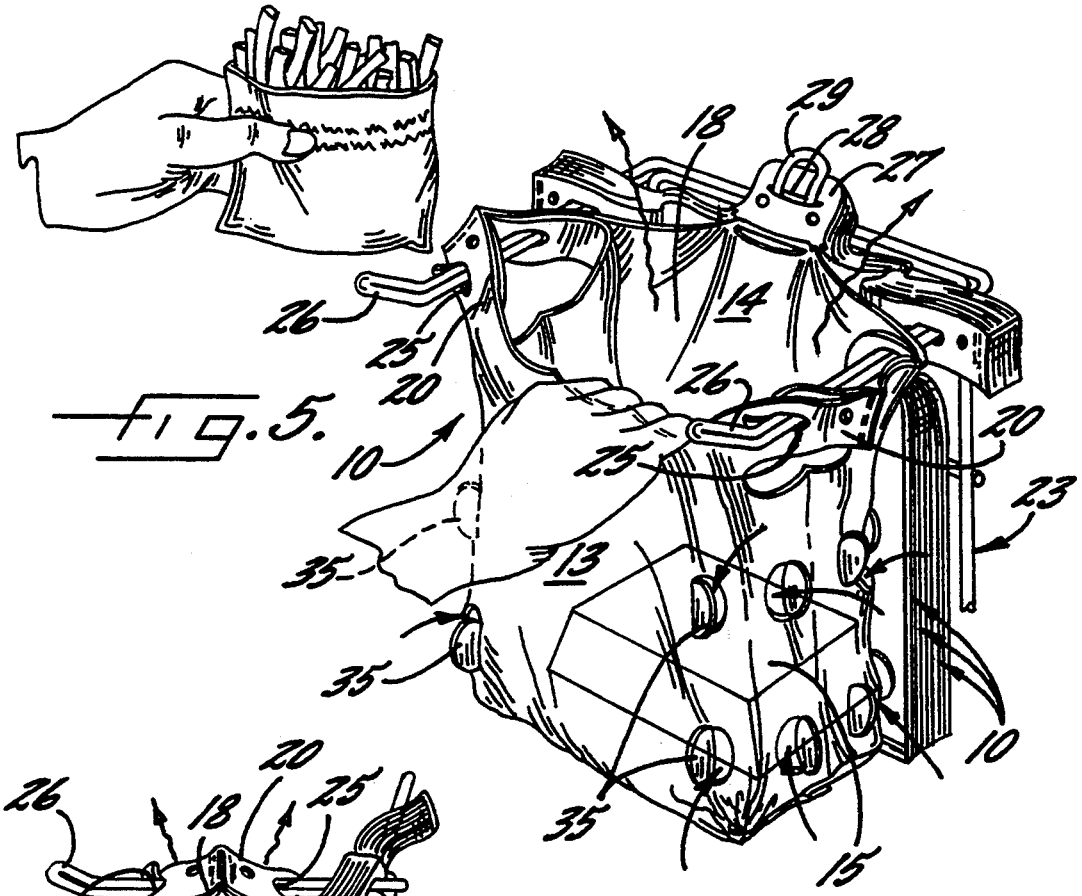
FIG. 5 is a perspective view, like FIG. 4, with the bag being loaded with hot food.

When the leading bag 10 from the pack of bags 10 is opened up on the rack 23, as shown in FIG. 5, the bag 10 is ready to receive the hot food such as a sandwich, as shown in dotted lines within the bag 10 and french fries as shown in the hand of the user to be placed in the bag 10. When these hot foods are placed in the bag 10, moisture will often collect on the inside of the plastic bag, condense and cause the food to get soggy and wet the hand of the user when reaching into the bag.

Figure 6:
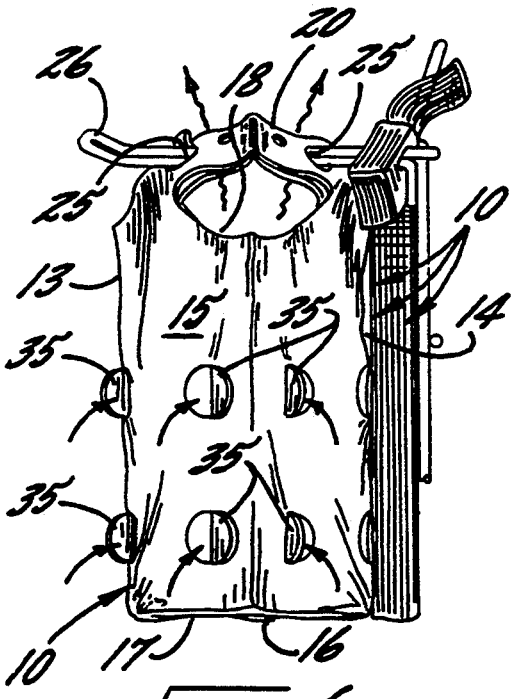
FIG. 6 is a side elevational view of the open loaded bag of FIG. 5.
Figure 7:
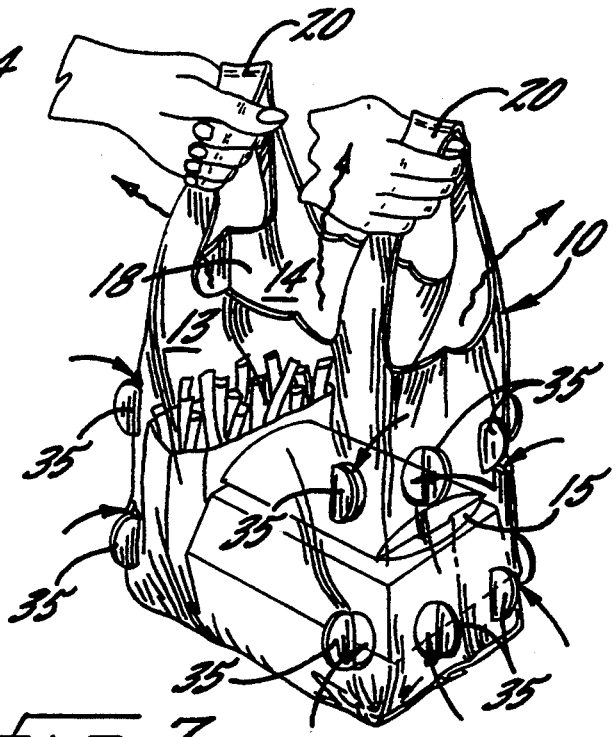
FIG. 7 is a perspective view of a loaded bag being carried by a user.

Accordingly, in accordance with this invention, aperture means 35 extend through at least one of the wall sections 13, 14, 15 for providing a path for a venting air flow from the outside of the bag 10 through the inside of the bag 10 when the bag is carrying hot food as shown in FIGS. 5, 6 and 7. This venting air flow is created along the path formed by the aperture means 35 inasmuch as heat rising from hot foods causing air to be drawn into the bag through such aperture means 35, through the bag and out of the bag in a manner well understood by those with ordinary skill in the art. The venting aperture means 35 are positioned near the closed bottom of the bag 10 to provide the path for a venting air flow from the outside of the bag 10, into the bag 10 near the bottom of the bag 10, through the inside of the bag 10 and out the top mouth 18 of the bag 10 when the bag is being carried upright by the handles 20, as shown particularly in FIG. 7. Preferably, the aperture means 35 comprise a plurality of apertures positioned in spaced arrangement from near the closed bottom of the bag 10 along the length of the bag 10 to near the top mouth 18 of the bag 10 to provide the path for a venting air flow from the outside of the bag 10, through the inside of the bag 10 and out of the bag 10, regardless of the position of the bag 10, i.e. the bag may be placed on its side when being transported in an automobile or the like.

Figure 3:
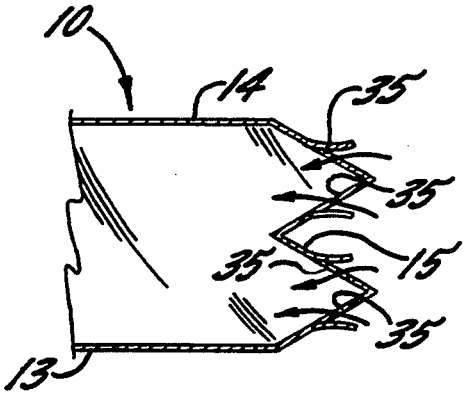
FIG. 3 is a sectional detail, taken generally along the line 3—3, through one of the bags of the bag pack of FIG. 1.
Figure 4:
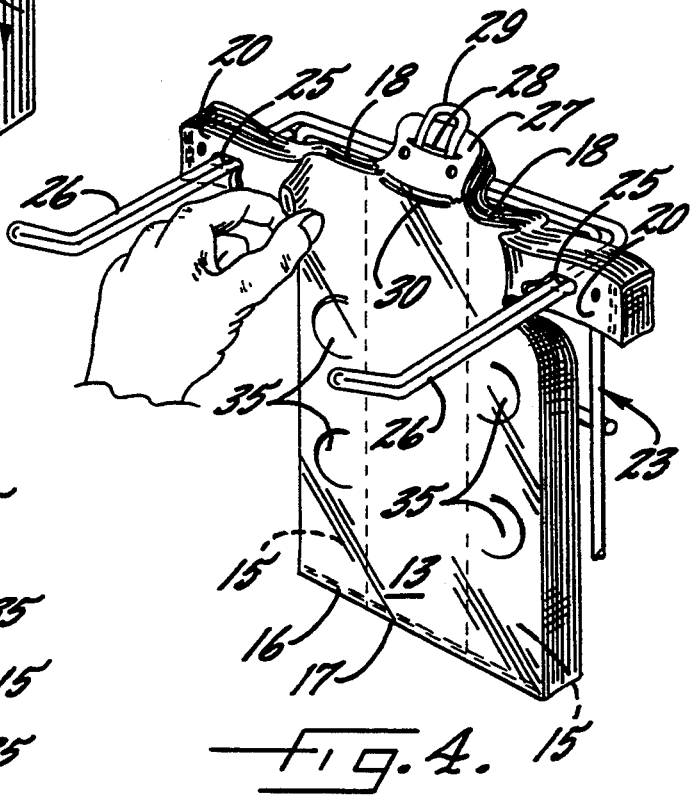
FIG. 4 is a perspective view of a pack of bags of FIG. 1 mounted on a rack mechanism and with the first bag being opened up for loading.

Preferably, the plurality of apertures 35 are spaced approximately 2-½ to 3 inches apart and comprise two spaced apertures extending through superimposed areas on each side of the front, rear and gussetted side wall sections 13, 14, 15 of the bag in the flat condition thereof, as shown in FIGS. 1, 3 and 4, to define two spaced apart apertures 35 on each side of the front and rear wall sections 13, 14 and four apertures 35 in each of the gussetted side wall sections.

Figure 2:
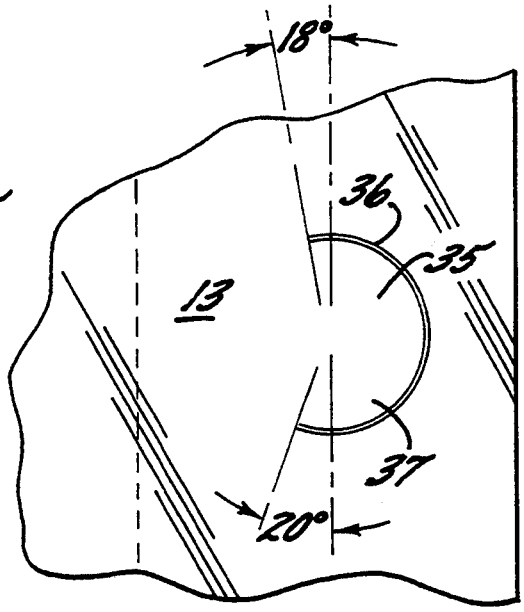
FIG. 2 is an enlarged detailed plan view of one of the aperture means extending through one of the wall sections of the bag of FIG. 1.

Each of the apertures 35 preferably comprises a generally semi-circular shaped cut 36 which defines a flap portion 37 which opens up to define a generally half moon shaped aperture. To prevent tearing or propagation of the cut 37, which usually happens along a longitudinal axis or in the machine direction of the bag 10, each semi-circular shaped cut 36 preferably extends approximately 20° past a 180° longitudinal axis on a bottom thereof and approximately 10° past the 180° longitudinal axis on a top thereof, as shown in FIG. 2. The semi-circular shaped cut preferably comprises an approximate 0.38 inch radius.

Each of the bags 10 is preferably of a length of about 4–10 inches from the bottom 17 to the mouth 18 so that a normal load, such as illustrated in FIG. 7, will extend upwardly approximately 50% of such length to keep the mouth 18 of the bag 10 open after loading to maintain the venting air flow through the bag 10.

The bag 10 may be formed of any suitable material, but is preferably formed of polyethylene film of the high density, medium density or low density type and which is unpigmented so as to provide a light transmission of approximately 80–95%, preferably about 90%, through the bag. This light transmission provides transparency through the bag so that the user, order filler, check-out person or purchaser, can readily observe the items packaged in the bag 10 to avoid mistakes, etc., in filling of the fast food order. This percentage light transmission can be determined, for example, by the use of an opacity meter, such as manufactured by Rite Systems, 1099 Atlantic Drive, West Chicago, Ill. 60185. ASTM has provided a standard test method for measuring transparency of plastic sheeting, i.e, Designation: D 1746-70, which can utilize this type of an opacity meter for determining light transmission.

With a T-shirt type plastic bag 10 constructed as described above in accordance with the present invention, such plastic bag can be used satisfactorily for hot foods and provide the ventilation or air circulation required to prevent problems which occurred with the use of plastic bags in carrying hot food in the past. The location and construction of the venting or air flow path apertures is such that air flow is created through the bag regardless of the position of the bag and the apertures are constructed so as to prevent propagation of the cut used to form such apertures.

In the drawings and specification there has been set forth a preferred embodiment of this invention, and although specific terms are employed, they are used in generic and descriptive sense only and not for purposes of limitation, the scope of the invention is defined in the following claims.

What is claimed is:

1. A T-shirt type plastic bag particularly adapted for carrying hot food form fast food restaurants and comprising front and rear wall sections; gussetted side wall sections integrally connecting said front and rear wall sections together; means connecting bottoms of said front, rear and gussetted side wall sections together to define a closed bottom; at least a part of said front and rear wall section being open at the tops to define a mouth portion; laterally spaced handles integral with said front, rear and gussetted side wall sections and extending upwardly from opposed sides of said mouth portion; and aperture means extending through at least one of said wall sections for providing a path for a venting air flow from outside of said bag and through the inside of said bag when said bag is carrying hot food, said aperture means comprises a generally semi-circular shaped cut which defines a flap portion which opens up to define a generally half moon-shaped aperture, said generally semi-circular shaped cut comprises a circumference of approximately 210° and extends approximately 20° beyond a 180° longitudinal axis through said bag on a bottom thereof and approximately 10° beyond the 180° longitudinal axis on a top thereof.

2. A T-shirt type plastic bag, as set forth in claim 1, wherein said venting aperture means are positioned near said closed bottom of said bag to provide the venting air flow path from the outside of said bag, into said bag near said bottom of said bag, through the inside of said bag and out said top mouth of said bag when said bag is being carried upright by said handles.

3. A T-shirt type plastic bag, as set forth in claim 1, wherein said venting aperture means comprise a plurality of aperture means respectively positioned in spaced arrangement from near said closed bottom of said bag along the length of said bag to near said top mouth of said bag to provide the venting air flow path from the outside of said bag, through the inside of said bag and out said bag regardless of the position of said bag.

4. A T-shirt type plastic bag, as set forth in claim 3, wherein said plurality of aperture means extend through said front and rear wall sections near each of said gussetted side wall sections.

5. A T-shirt type plastic bag, as set forth in claim 4, wherein said plurality of aperture means comprise two spaced aperture means on each side of said front and rear wall sections.

6. A T-shirt type plastic bag, as set forth in claim 3, wherein said plurality of aperture means extend through superimposed areas on each side of said front, rear and gussetted side wall sections of said bag in flat condition thereof and define two spaced aperture means on each side of said front and rear wall sections and four apertures in each of said gussetted side wall sections.

7. A T-shirt type plastic bag, as set forth in claim 1, wherein said generally semi-circular shaped cut comprises an approximately 0.38 inch radius.

8. A T-shirt plastic bag, as set forth in claims 1, 2, 3, 4, 5, or 6, wherein said bag is constructed of unpigmented polyethylene film material and has about 80–95% light transmission therethrough to allow the user to see the contents of said bag.

9. A T-shirt plastic bag, as set forth in claims 1, 2, 3, 4, 5, or 6, wherein said bag is of a length from about 4–10 inches from said bottom to said mouth so that a normal load will extend upwardly approximately 50% of the said length to keep said mouth of said bag open after loading to maintain the venting air flow through said bag.

10. A T-shirt plastic bag, particularly adapted for carrying hot food from fast food restaurants; said bag being constructed of unpigmented polyethylene film material having about 80–95% light transmission therethrough to allow the user to see the contents of said bag; said bag comprising front and rear wall sections; gussetted side wall sections integrally connecting said front and rear wall sections together; means connecting bottoms of said front, rear and gussetted side wall sections together to define a closed bottom; at least a part of said front and rear wall sections being opened at the tops to define a mouth portion; laterally spaced handles integral with said front, rear and gussetted side wall sections extending upwardly from opposed sides of said mouth portion; venting aperture means comprising a plurality of aperture means respectively positioned in spaced arrangement from near said closed bottom of said bag along the length of said bag to near said top of said bag to provide a path for a venting air flow from the outside of said bag and through the inside of said bag and out of said mouth portion of said bag when said bag is being carried upright by said handles, said plurality of aperture means comprising two spaced apertures means on each side of said front and rear wall sections and extending through superimposed areas on each side of said front, rear and gussetted side wall sections of said bag in a flap condition thereof to define two spaced aperture means on each side of said front and rear wall sections and four apertures in each of said gussetted side wall sections, each of said aperture means comprising a generally semi-circular shaped cut which defines a flap portion which opens up to define a generally half moon-shaped aperture, said generally semi-circular shaped cut comprises a circumference of approximately 210° and extends approximately 20° beyond a 180° longitudinal axis through said bag on a bottom thereof and approximately 10° beyond the 180° longitudinal axis on a top thereof; and said bag being of a length from about 4–10 inches from said bottom to said mouth so that a normal load will extend upwardly approximately 50% of said length to keep said mouth of said bag opened after loading for maintaining the air flow therethrough.

* * * * *

UNITED STATES PATENT AND TRADEMARK OFFICE

CERTIFICATE OF CORRECTION

PATENT NO. : 5,362,152

DATED : November 8, 1994

INVENTOR(S) : Wade D. Fletcher & Harry B. Wilfong, Jr.

It is certified that error appears in the above-identified patent and that said Letters Patent is hereby corrected as shown below:

Column 2, line 46, after "bags" insert -- 10 --.

Column 2, line 52, after "bags" insert -- 10 --.

Column 2, line 60, after "handles" insert -- 20 --.

Column 3, line 26, "causing" should be -- causes --.

Column 3, line 50, after "bag" insert -- 10 --.

UNITED STATES PATENT AND TRADEMARK OFFICE

CERTIFICATE OF CORRECTION

PATENT NO. : 5,362,152

DATED : November 8, 1994

INVENTOR(S) : Wade D. Fletcher & Harry B. Wilfong, Jr.

It is certified that error appears in the above-indentified patent and that said Letters Patent is hereby corrected as shown below:

Column 4, line 41, "form" should be --from --.

Column 6, line 25, 'flap" should be --flat --.

Signed and Sealed this

Thirty-first Day of January, 1995

*Attest:*

*Attesting Officer*

BRUCE LEHMAN

*Commissioner of Patents and Trademarks*